US006334477B1

(12) United States Patent
Moir

(10) Patent No.: US 6,334,477 B1
(45) Date of Patent: Jan. 1, 2002

(54) ADAPTER FOR HANGING BLINDS AND CURTAINS

(76) Inventor: Alan R. Moir, 178 Uplands Drive, Kitchener, Ontario (CA), N2M 4X6

( * ) Notice: Subject to any disclaimer, the term of this patent is extended or adjusted under 35 U.S.C. 154(b) by 0 days.

(21) Appl. No.: 09/552,794

(22) Filed: Apr. 20, 2000

(51) Int. Cl.[7] ..... E06B 3/32

(52) U.S. Cl. ..... 160/168.1 V; 160/89; 160/84.01

(58) Field of Search ..... 160/168.1 V, 176.1 V, 160/84.01, 89, 345, 900; 16/87.2, 87.4 R, 94 D, 95 D, 96 D

(56) References Cited

U.S. PATENT DOCUMENTS

| | | | | |
|---|---|---|---|---|
| 2,302,341 A | | 11/1942 | Nash | |
| 2,703,429 A | | 3/1955 | Sarkisian | |
| 3,137,027 A | | 6/1964 | Birkle | |
| 3,844,330 A | * | 10/1974 | Hyman | 160/168.1 V |
| 3,851,699 A | * | 12/1974 | Shapiro | 160/168.1 V |
| 3,951,196 A | * | 4/1976 | Salzmann | 160/345 |
| 4,115,899 A | * | 9/1978 | Ford | 160/345 X |
| 4,291,738 A | | 9/1981 | Grenga et al. | |
| 4,675,939 A | | 6/1987 | Fukada | |
| 4,964,191 A | | 10/1990 | Wyatt | |
| 5,012,552 A | * | 5/1991 | Wulf | 160/89 X |
| 5,282,292 A | | 2/1994 | Levy | |
| 5,291,632 A | | 3/1994 | Akashi | |
| 5,339,883 A | * | 8/1994 | Colson et al. | 160/176.1 X |
| 5,379,496 A | | 1/1995 | Krauss | |
| 5,392,833 A | * | 2/1995 | Ohansesian | 160/168.1 V X |
| 5,819,833 A | * | 10/1998 | Swiszcz et al. | 160/168.1 V |
| 6,098,246 A | * | 8/2000 | Moir | 160/345 X |

FOREIGN PATENT DOCUMENTS

| | | |
|---|---|---|
| CA | 8560616 | 11/1970 |

OTHER PUBLICATIONS

Brochure "Laserlite, contract window hardware", No. 12505 ALT/BuyLine 2415.
Brochure "LaserDrape V–3000/ Laserlite".

* cited by examiner

*Primary Examiner*—David M. Purol
(74) *Attorney, Agent, or Firm*—R. Craig Armstrong

(57) ABSTRACT

This invention relates to a curtain and blind carrying system which permits curtains and blinds to be hung from conventional vertical blind systems both simultaneously and separately. Provided is a track, a plurality of carriers slidably mounted for movement along the track, a plurality of glides, namely one per carrier, detachably securable to each carrier so as to extend downwardly therefrom, each glide including at least one curtain accepter, such as a female portion to receive a males portion of a male-female snap fastener assembly, and further including a vertical vane accepter, such as a clip portion extending downwardly therefrom for accepting the upper portion of a vertical vane. A curtain having a plurality of male portions of male-female snap fastener assemblies evenly spaced longitudinally, and adjacent an upper edge of the curtain is attached by inserting its male portions into the female portions on the glide. The upper edge of vertical vanes may be inserted into the clip.

11 Claims, 5 Drawing Sheets

ADAPTER FOR HANGING BLINDS AND CURTAINS

BACKGROUND OF THE INVENTION

1. Field of the Invention

This invention relates to coverings for windows and doors or the like, and in particular to a glide which permits curtains and blinds to be simultaneously hung from conventional vertical blind hardware.

2. Description of the Prior Art

The use vertical blind tracks to hang blinds over windows is well known. Typically vertical strips or vanes are clipped at the top and hang from the glides. Each glide is attached to one of a number of carriers, which typically run along a downwardly-opening U-shaped track, placed atop a window. The carriers are slidable along the length of the track, secured within the length of the track and are linked together along the track by spacer link pieces of equal length. Spacer link pieces are slidably connected to one another, so that the spacer link pieces can move from a bunched up position to a spread out position. In the bunched up position, the spacer link pieces overlap. In the spread out position, they extend evenly over the entire track. Each carrier is positioned on one spacer link piece, and is free to slide along each spacer link piece. Because the spacer link pieces are of equal length, the carriers become evenly spaced along the track when the spacer link pieces are fully spread out along the track. Spacer link pieces and the attached carriers are movable from the bunched up position to the spread out position by means of a cord or by means of a wand which is attached to the end carrier, which is itself is attached to the end spacer link piece. In the cord system, the cord runs the entire length of the track and is operable by a pulley system at one end of the track. Because the carriers are evenly spaced along the track, the blinds hang adjacent to each other, uniformly spaced across the entire length of the track.

It is also known to hang curtains from vertical blind track hardware using glides adapted for hanging curtains. These adapted glides are attached to carriers, running along horizontal blind tracks, as described above, each glide including the female portion of a snap fastener, extending downwardly from the glide. A curtain having male portions of a snap fastener assembly evenly spaced along its top edge such that they align with the glides is attached to the hardware by snapping each male portion into the corresponding female portion extending from the bottom of each glide, such that the curtain is evenly spaced along the blind track. Another example, Canadian patent number 856,016 issued to Kirsch Company teaches a plurality of carriers slidably mounted to a horizontal blind track whereby drapery is attached to each carrier by means of a hook.

The adapting of curtains or drapery to be hung from a vertical blind track attempts to allow for even pleating of the curtain when it is drawn, creating a neat visual appearance. The use of the snap fastener or hook attachment allows for easy attachment and removal of the curtains.

It is also known to utilize conventional vertical blind units to hang curtains and blinds simultaneously. One known apparatus attempts to hang vertical blinds and curtains simultaneously using conventional vertical blind vanes clipped to glides attached to conventional horizontal blind track carriers. Velcro is attached to the upper portion of each vertical vane, rather than on the glide or the carrier. The velcro mate is attached along the upper edge of the curtain. The curtain may then be attached to the blind track unit by attaching the velcro along its upper edge to the velcro attached along the top of each vane.

Since the curtain is attached to the vertical vane, this apparatus does not allow curtains to be hung without simultaneous hanging of the vertical vane. Furthermore, when attaching the velcro portion of the curtain, it is difficult to align the curtain so that the proper portion of the curtain is attached to each vane. Considerable time and labour is required to measure and mark up the velcro upper edge of the curtain to ensure correct positioning.

Additionally, curtains attached to vanes by means of velcro tend to wear and eventually cause the curtain to hang unevenly, losing the even pleating and neat visual appearance when the curtains are drawn.

In light of the above there is a need for an improved apparatus which allows curtains and blinds to be hung both simultaneously and separately from conventional blind hardware.

SUMMARY OF THE INVENTION

It is an object of the invention to provide a glide which improves upon the prior art. In particular it is an object of the invention to provide a glide which allows curtains and vertical blinds to be hung from the carriers normally used for vertical blinds both simultaneously and separately.

In accordance with an aspect of the invention there is provided a curtain system, comprising a track, a number of carriers slidably mounted for movement along the track, a number of glides, namely one per carrier, detachably securable to each carrier, extending downwardly therefrom, each glide including an curtain accepter and a vertical vane accepter, whereby an upper edge of a curtain is detachably securable to said curtain accepter and an upper edge of a vertical vane is detachably securable to said vertical vane accepter.

In accordance with a further aspect of the invention the curtain accepter comprises a female portion shaped to receive the male portion of a male-female snap fastener assembly. The upper portion of the curtain includes a plurality of male portions of male-female snap fastener assemblies secured thereto, evenly spaced along the upper edge of said curtain. The vertical vane accepter comprises a clip extending downwardly from said glide, each said vertical vane having a upper edge adapted to be detatchably secured into each said clip. The upper edge of each vertical vane may be inserted into each said clip securing each in place. The upper edge of the curtain may be attached to the curtain system by aligning the upper edge of the curtain such that each male portion is snapped into the female portion of each glide along the entire track.

In accordance with a further aspect of the invention, each clip comprises a first and second resilient member, each extending downwardly from each glide, each member having an inner side, an outer side and a head portion positioned adjacent to each distal end, the head portion of said first member being in close contact with the head portion of the second member, the first and second members being separated from each other except at said head portions, so as to define a gap between said members, and where one said female portion is attached to the outer side of each said first and second members.

In accordance with yet a further aspect of the invention, glides are rotatable within said carriers such that when vanes are inserted into each glide, they are rotatable from an open position to a closed position.

The invention provides the advantage of allowing curtains and blinds to be hung simultaneously from conventional vertical blind tracks as well as allowing blinds or curtains to be hung separately. Additionally, because the invention uses precisely spaced attachment of the curtains to the blinds, the time and effort to align and attach the curtain for proper spacing is reduced from the methods and apparatus previously known such as with velcro. The invention thus provides the further advantage of easier alignment when attaching or reattaching the curtain. Further, the use of the snap fasteners as opposed to velcro to attach the curtains ensures that they do not wear or tear as quickly as with velcro.

Further features of the invention will be described or will become apparent in the course of the following detailed description.

BRIEF DESCRIPTION OF THE DRAWINGS

The invention will now be described in detail with reference to the accompanying drawings of the preferred embodiment by way of example. In these drawings.

DETAILED DESCRIPTION OF THE PREFERRED EMBODIMENT

Figure 1:
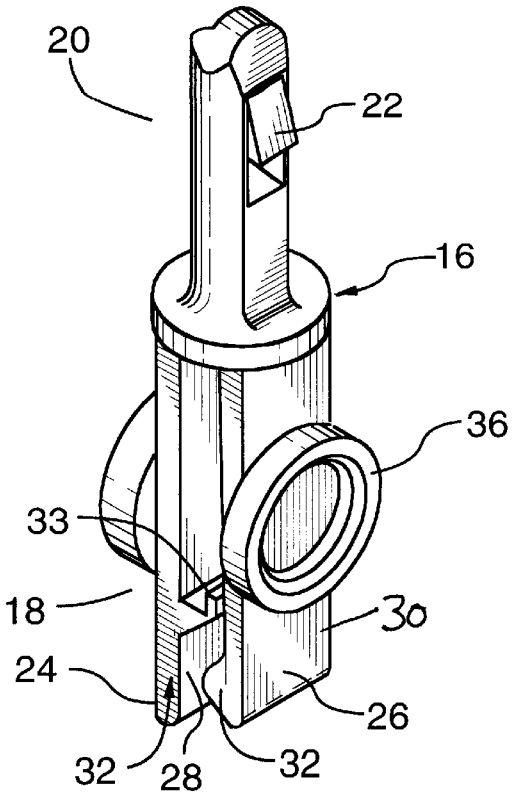
FIG. 1 is perspective view of the preferred embodiment of the glide.

In the preferred embodiment of the invention, as shown in FIGS. 1–9, carriers 10 are movable on a vertical blind track 12 and are designed to be evenly spaced along the track when spread out along the length of the track. The blind track is generally U-shaped and downwardly opening. Preferably each carrier has a downwardly opening aperture 14 shaped to receive a glide 16. Glides 16 are provided, each preferably having a lower body portion 18 and an upwardly extending piece 20 including a depressable catch tongue 22. When the upwardly extending piece 20 is fully inserted into the downwardly opening aperture 14, the depressable catch tongue piece catches against the interior of the aperture 14, thus securing the glide into the carrier aperture 14.

Figure 2:
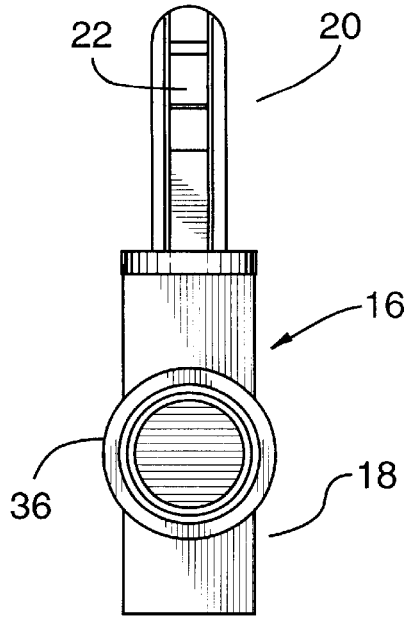
FIG. 2 is a side view of the preferred embodiment of the glide.
Figure 3:
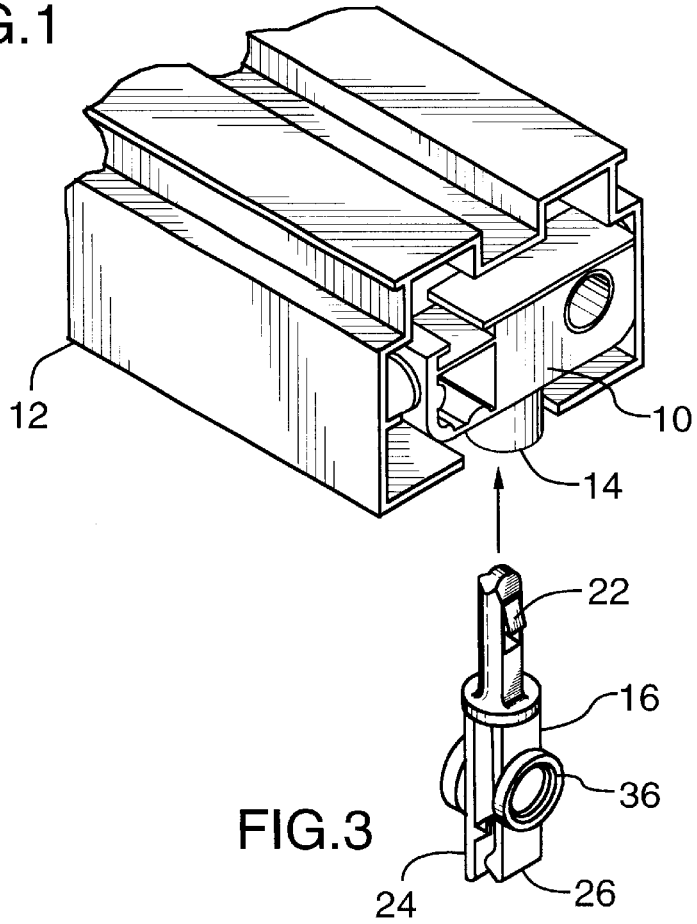
FIG. 3 is a side view of the glide being inserted into a carrier.

As shown in FIGS. 1–3, in the preferred embodiment, the lower body portion 18 of the glide extends downwardly from the carrier and includes a vane accepter, preferably comprising a clip, which includes a first 24 and second 26 clip member, extending downward from the glide, each having an inner side 28 outer side 30 and a head portion 32 at each distal end. A holder 33 on the first clip member 24 is in close contact with the head portion 32 of the second member.

Figure 4:
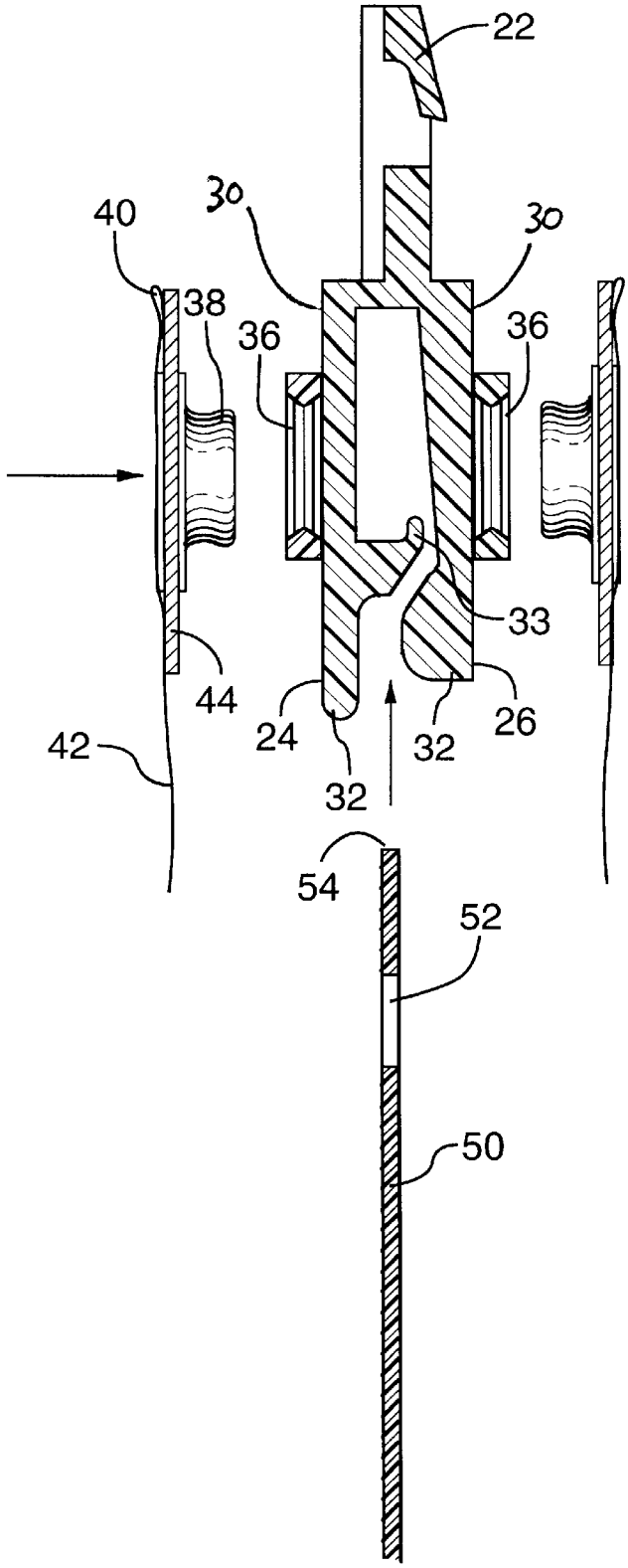
FIG. 4 is side sectional view of vane and curtain being attached to a glide.
Figure 5:
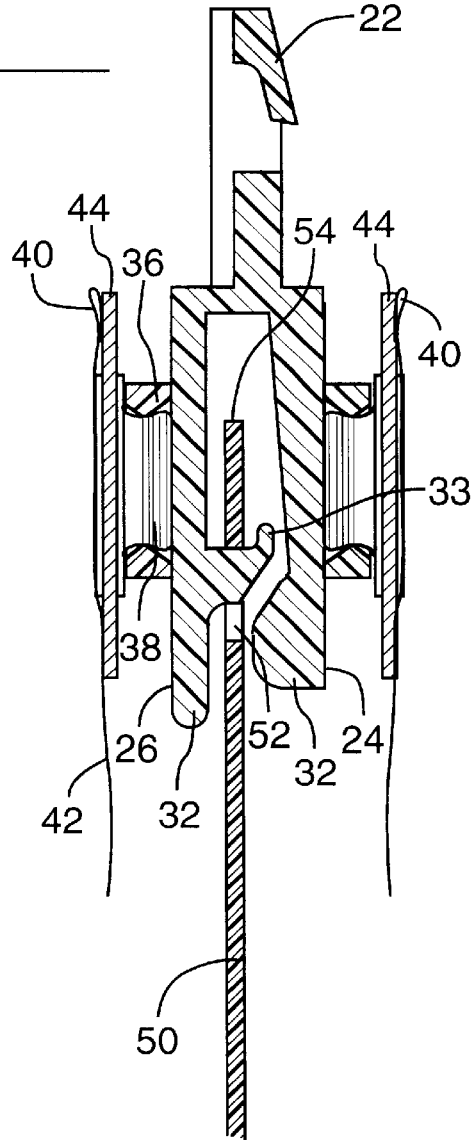
FIG. 5 is a side sectional view of a vane and curtain attached to a glide.
Figure 6:
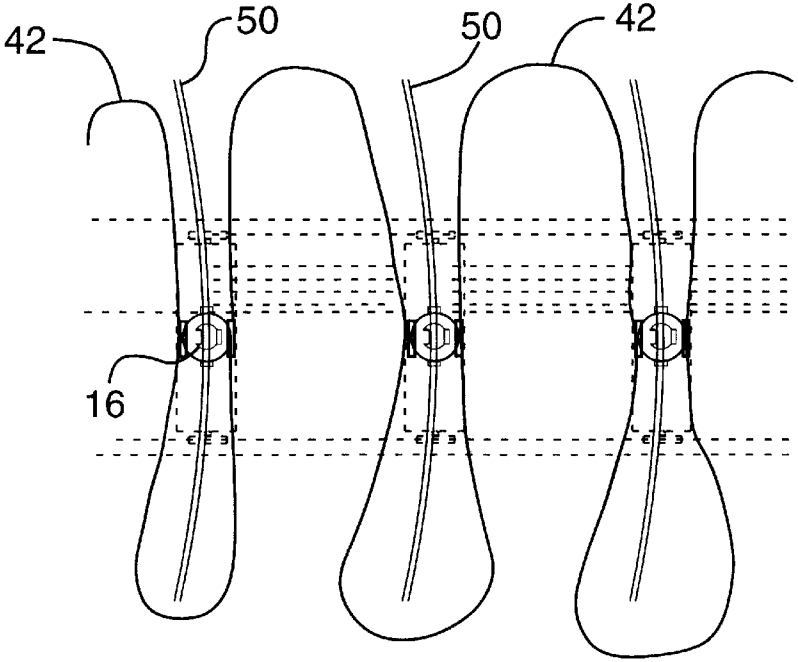
FIG. 6 is a bottom elevation view of a plurality of glides with vanes and curtain attached.

As shown in FIGS. 4–6 the upper edge 54 of each vertical vane 50, is detachably securable to the vane accepter preferably by means of an opening 52 at each upper edge 54 which may be inserted between said members 24,26 securing them in place on the holder 33.

The glide further includes at least one curtain accepter. Preferably the curtain accepter comprises a female portion 36 of a male female snap fastener assembly, preferably circular, configured to receive the male portion of a conventional snap fastener. Preferably, each female portion is attached to the outer side 30 of each clip member 24,26. Preferably, the angle of the female portions on each glide in relation to the blind track is the same for each carrier in order to ensure that the curtains hang evenly.

Figure 7:
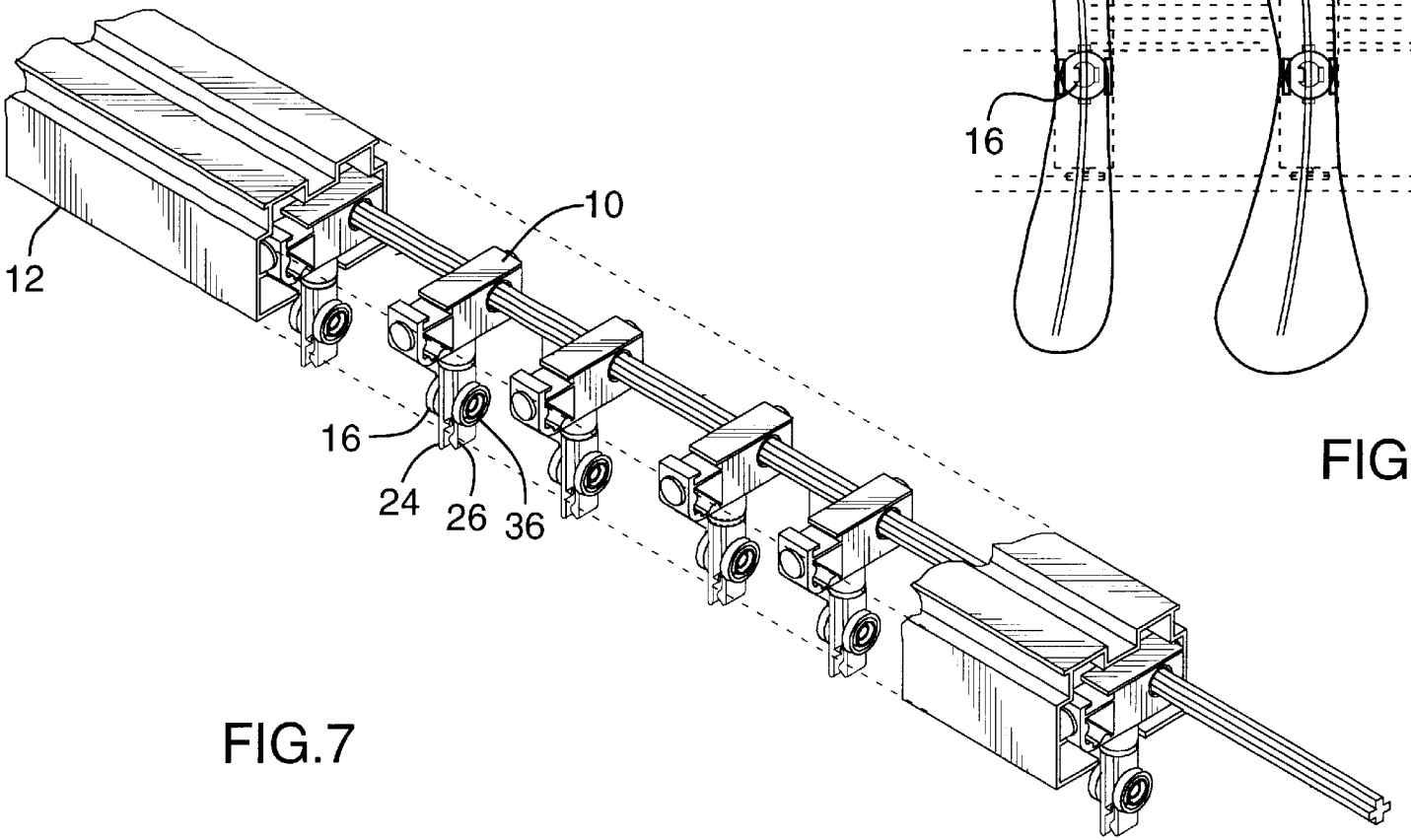
FIG. 7 is a sectional perspective view of the preferred embodiment of a vertical blind track system.

As shown in FIG. 7 in the preferred embodiment, rotation of the glides within the carrier system is actuated by a means of standard worm gear apparatus which rotates the glides from an open position where the vanes are positioned perpendicular to the length of the blind track (shown in FIG. 9) to closed position where the vanes are rotated to parallel to the length of the blind track. This rotation allows to user to control the amount of light which may pass through the curtains and vanes.

Figure 9:
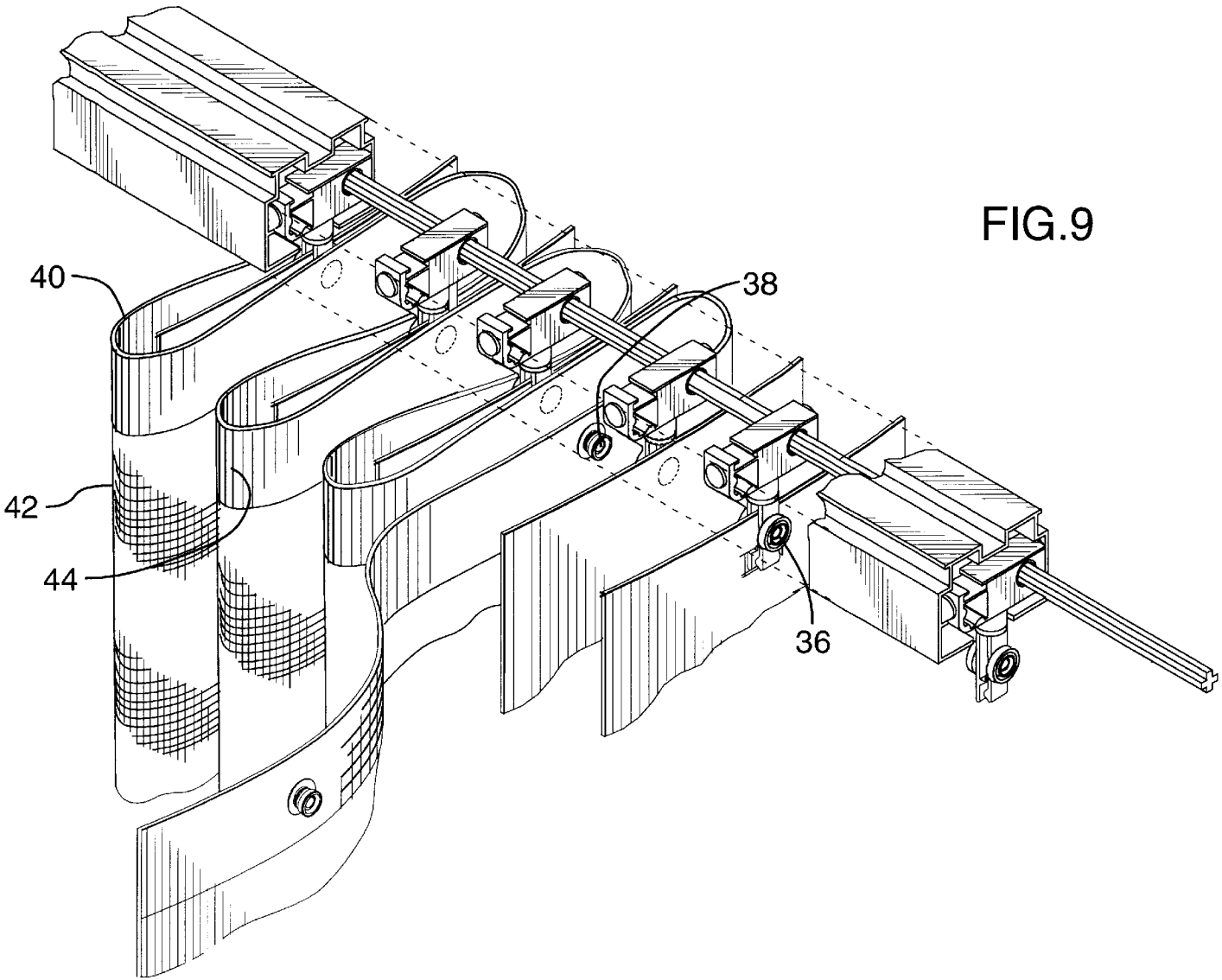
FIG. 9 is a sectional perspective view of the preferred embodiment of a vertical blind track system with vanes and curtain attached to glides.

Shown in FIG. 5 and 9, in the preferred embodiment, male portions 38 of conventional snap fasteners, are placed along the upper edge 40 of a curtain 42, evenly spaced along the length of the upper edge. The preferred distance between the fasteners should be more than the distance between each carrier when they are maximally spread out along the track. Preferably, the male portions of the snap fastener are provided by a snap tape product 44 which has male portions 38 of the snap fastener attached to it, spaced at regular intervals along its length. The snap tape product is then secured to the upper edge of the curtain 42. Use of this snap tape product allows curtains to be easily adapted to vertical blind hardware by simply securing the snap tape to the upper edge of a curtain. Alternately, the male portions may be attached to the curtain directly. In order to ensure that the fasteners do not tear out of the curtain, a strip of additional supporting material can be hemmed along the upper edge of the curtain.

To hang the curtain, each end of the curtain is aligned to the carriers at each end of the blind track, and the male portions 38 of the snap fasteners in the curtain are snapped into the female portions 36 of the snap fastener, thus fixing the snap fasteners in place. The curtain can be opened or closed by operating a pulley or wand system, which moves the carriers along the blind track, as described in the prior art.

Figure 8:
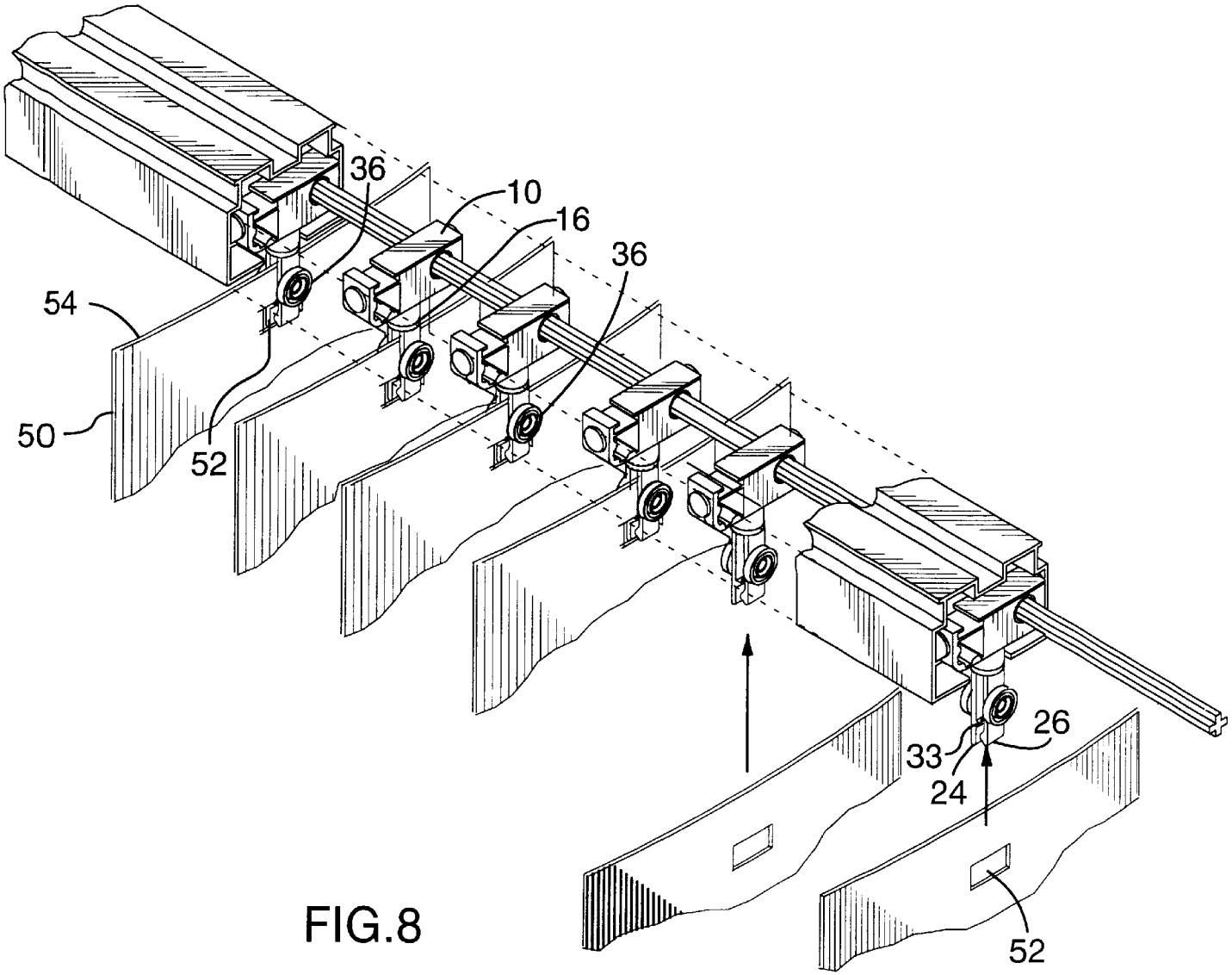
FIG. 8 is a sectional perspective view of the preferred embodiment of a vertical blind track system with vanes attached to glides.

In the preferred embodiment, vanes may be hung without curtains as shown in FIG. 8 or simultaneously with the curtains as shown in FIG. 9. Of course, it is also possible to curtains without hanging the vanes.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the vane accepter could be any suitable shape or form and could accept the upper edge of vanes by any suitable means, such as by means of hooks, velcro or adhesive. Also, the curtain accepter could accept the upper edge of the curtain by any suitable attachment means such as with velco or adhesive or hooks. The snap fastener assembly could be any suitable shape, not necessarily circular. Additionally, the upper extending piece of the glide could contain any type of securing means to the carrier, namely an hook and latch mechanism or some form or use of adhesive. The lower body portion of the glide could be any shape. Furthermore, the curtain could contain any type of reinforcement to ensure that the male piece of the snap fastener assembly units do not tear out of the curtain.

What is claimed is:

1. A curtain and vane carrying system, comprising:

a track;

a curtain;

a plurality of vertical vanes;

a plurality of carriers slidably mounted for movement along said track;

a plurality of glides, one per each said carrier, detachably securable to each said carrier so as to extend downwardly therefrom, each said glide having at least one curtain accepter and a vane accepter, such that an upper edge of the curtain is detachably securable to said curtain accepter and an upper edge of the vertical vane is detachably securable to said vane accepter, said vane accepter comprising a clip extending downwardly from said glide and having a holder for cooperation with an opening arranged at said upper edge of the vane, to detachably secure the vane in said vane accepter;

said curtain accepter comprising a first portion of a snap fastener assembly configured to receive a second portion of said snap fastener assembly; said upper edge of the curtain includes a plurality of said second portions of said snap fastener assembly secured thereto, evenly spaced longitudinally, and adjacent said upper edge of the curtain, whereby the curtain may be attached to said track by inserting said second portions into said first portions and the vanes may be attached to said track by inserting said upper edge of each vane into each said clip, without having to remove the vane when removing the curtain and without having to remove the curtain when removing the vane.

2. The curtain and vane carrying system as recited in claim 1, where said first portion of said snap fastener assembly is a female part of said snap fastener; and said second portion of said snap fastener is a male part of said snap fastener assembly.

3. The curtain and vane carrying system as recited in claim 1, where each said glide comprises:

an upwardly extending piece; said upwardly extending piece including a depressable catch tongue piece extruding from its side; and said carrier includes a downwardly opening aperture shaped to receive said upwardly extending piece of each said glide.

4. The curtain and vane carrying system as recited in claim 1, where each said clip comprises a first and second resilient member, each extending downwardly from each said glide, each said member having an inner side, an outer side, a distal end and a head portion positioned adjacent to each said distal end; the head portion of said first member including a holder, being in close contact with the head portion of the second member, said first and second members being separated from each other except where said holder is in close contact with the head portion of said second member, so as to define a gap between said members.

5. The curtain and vane carrying system as recited in claim 4, where one said first portion is attached to said outer side of each said first and second members.

6. The curtain and vane carrying system as recited in claim 1, where said curtain comprises a strip of additional supporting material hemmed to said curtain adjacent to the upper edge of said curtain, said male portions secured to said curtain and said additional supporting material.

7. The curtain and vane carrying system as recited in claim 5, where the angle of said first portion in relation to a length of said track is equal for each glide once each said glide is attached to each said carrier.

8. The curtain and blind carrying system as recited in claim 1, where said glides may be rotated from an open position to a closed position;

said open position being where said first portions are aligned parallel to the length of said track and said closed position being where said first portions are aligned perpendicular to said track.

9. The curtain and blind carrying system as recited in claim 1, where said plurality of second portions of said snap fastener assembly are secured to the curtain by means of a snap tape having said second portions arranged at predetermined intervals along said snap tape.

10. The curtain system and blind carrying system as recited in claim 9, where said second portions are spaced along said snap tape material at every 4¼ inches.

11. The curtain and blind carrying system as recited in claim 1, where said glide comprises a lower body portion including two said first portions to receive said second portions of said snap fastener assembly; positioned on opposite sides of each said glide.

* * * * *